United States Patent [19]

O'Connor

[11] 4,204,295

[45] May 27, 1980

[54] GROUT SCRUBBER AND CLEANING TOOL FOR TILE

[76] Inventor: John D. O'Connor, 1817 Robin Hood, Sarasota, Fla. 33581

[21] Appl. No.: 953,851

[22] Filed: Oct. 23, 1978

[51] Int. Cl.[2] ..... A49L 13/04; B25G 1/00

[52] U.S. Cl. ..... 15/209 D; 15/144 A

[58] Field of Search ..... 15/144 A, 209 D, 244 R, 15/244 A

[56] References Cited

U.S. PATENT DOCUMENTS

| | | | |
|---|---|---|---|
| 2,958,593 | 11/1960 | Hoover et al. | 15/209 R X |
| 3,778,860 | 12/1973 | Thielen | 15/147 A |
| 3,991,431 | 11/1976 | Thielen | 15/147 A |

FOREIGN PATENT DOCUMENTS

| | | | |
|---|---|---|---|
| 946769 | 12/1948 | France | 15/209 D |
| 165458 | 2/1934 | Switzerland | 15/209 D |
| 331623 | 7/1930 | United Kingdom | 15/228 |

*Primary Examiner*—Edward J. McCarthy

[57] ABSTRACT

A tool useful for cleaning and removing excess grout from a tile surface, be it cementitious or epoxy resin grout, while additionally forming and smoothing the grout joint comprising a rigid rectangularly-shaped plate, the scrubbing pad sized and shaped to conform to said plate, said scrubbing pad being of a fiber-like consistency, an elongated handle connected to the upper portion of said plate and said handle being connected on a universal joint to allow relative movement between said handle and said plate in two perpendicular planes, and a connector for affixing a pad removably to the bottom surface of the plate. The pad is of a fiber steel wool-like consistency such as the pad known as SCOTCHBRITE, a trademark of the 3M Company. The tool is used in conjunction with small amounts of water and allows the pad to apply equal pressure while having variable movement around the edges, corners, and the like to apply a scrubbing pressure to the surface of the tile and the tile joint.

1 Claim, 4 Drawing Figures

GROUT SCRUBBER AND CLEANING TOOL FOR TILE

BACKGROUND OF THE INVENTION

This invention relates generally to a tool that may be used in a standing position by an operator that allows excess grout to be expeditiously removed from the tile surface for cleaning the tile while at the same time removing excess grout along the upper surface of the grouting joints to provide a finished appearance to the tile.

One of the most time-consuming aspects of tiling a floor surface, using either cementitious or resin epoxy-type grouting, is that after the grouting application is completed, the tile surface itself must be scrubbed clean and the grouting joints sufficiently smoothed to complete the grout job. In the past, this has been done by the operator literally scrubbing each tile and tile joint on his hands and knees with scrapers and cleaners and the like. It is extremely time consuming and quite costly in operation and requires hard labor to perform this job.

The present invention overcomes the drawbacks in the prior art cleaning devices by providing a tool which may be used in a standing position for scrubbing both the tile and the grouting joints to remove any excess grout while allowing the operator to scrub in hard to get at places and which allows for the application of uniform pressure on a rigid plate from the standing position.

BRIEF DESCRIPTION OF THE INVENTION

This invention relates generally to a tool that is useful for scrubbing and cleaning tile and adjacent grouting joints by an operator from a standing position comprising a rigid rectangular plate, an elongated handle connected to the upper surface of said plate, said connection including first and second movable joints which allow the handle to be moved in two mutually perpendicular planes relative to the upper surface of the plate, and a tile scrubbing pad made of a fiberous material which is connected to the bottom surface of the plate. The pad in one embodiment is constructed of a steel wool-like material which is useful for polishing or scraping and buffing tile surfaces and grout joints known under the trademark as SCOTCHBRITE, a trademark of the 3M Company. The pad is shaped and sized to extend one-half inch beyond the outer perimeter of the plate. This overlap prevents plate edge contact with wall surfaces or the like.

The universal joint connecting the handle with the upper surface of the plate includes a pair of projecting mounting members affixed to the top of the plate and a bolt acting as the axis which is connected to a second dual flanged plate having a second bolt perpendicular to the first bolt which allows the handle to be moved in two mutually perpendicular planes.

In operation, the operator in a standing position would in conjunction with small amounts of water utilize the tool to press, forming uniform pressure distribution across the pad to, in a back and forth motion, scrub the tile and grout joint surface. With the universal axle, the tool may be utilized in remote or hard to get at areas by moving the axle joint to position the plate and pad where desired. The peripheral shape of the plate permits operation along wall edges and in corners.

It is an object of this invention to provide an improved scrubbing tool for scrubbing tile and tile grouting joints.

It is another object of this invention to provide a tool for scrubbing tile that may be used in a standing position which greatly reduces the time required for cleaning excess grout from tile surfaces and from the grouting joints.

In accordance with these and other objects which will be apparent hereinafter, the instant invention will now be described with particular reference to the accompanying drawings.

PREFERRED EMBODIMENT OF THE INVENTION

Figure 1:
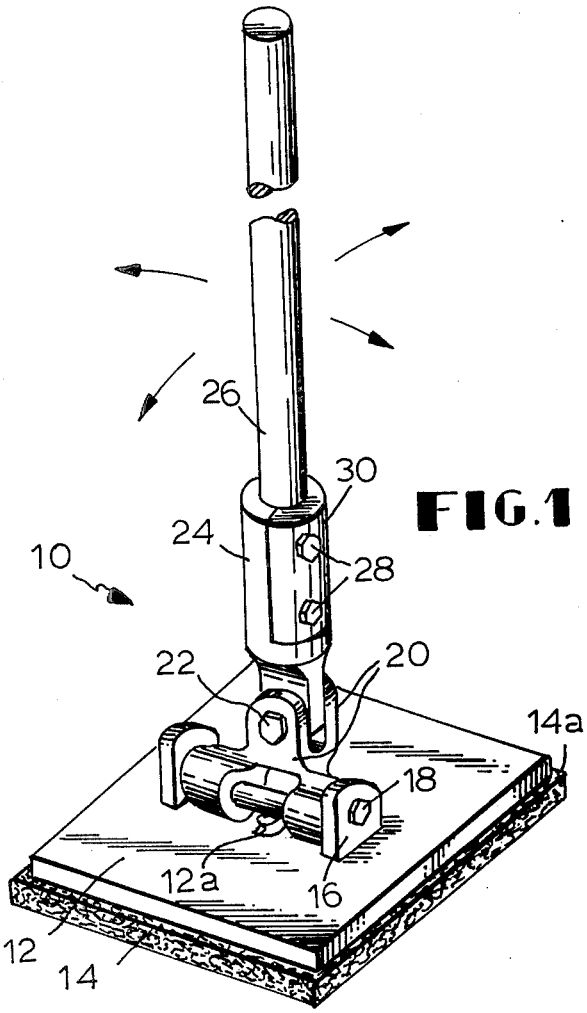
FIG. 1 shows a perspective view of the present invention.

Referring now to the drawings and specifically FIG. 1, the present invention is shown generally at 10 comprised of a rigid square plate 12 having a fiberous pad 14 attached on the bottom side of plate 12. The upper portion of the plate includes a universal joint including side flanges 16 having a bolt 18 attached therethrough forming an axle for an upper flange 20 having a bolt 22 which is connected to a handle receiving aperture 24 and handle cap 30. The handle 26 is connected to the handle receiving aperture 24 and handle cap 30 by bolts 28.

Figure 2:
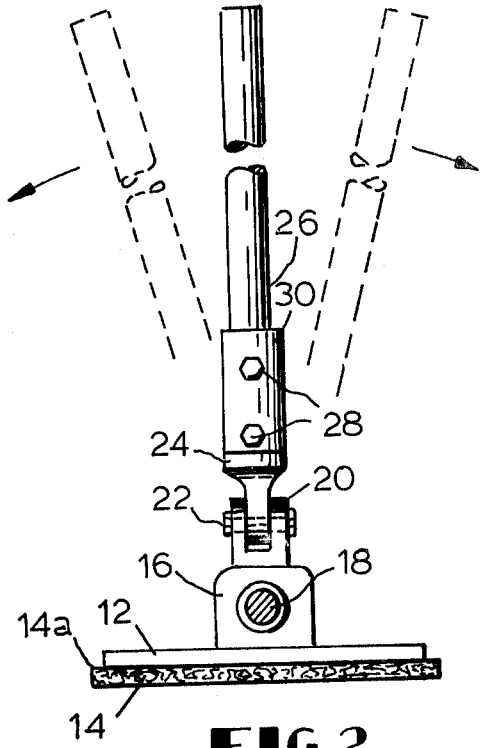
FIG. 2 shows a side elevational view showing one direction of movement of the tool handle with the axis of movement in cross-section.

FIG. 2 shows how the handle may move in one plane in both directions by the pivoting action of the handle relative to the rigid plate through the movement of and around the axis formed by bolt 18. The pad edge 14a overlaps and extends beyond the peripheral edge of the plate 12.

Figure 3:
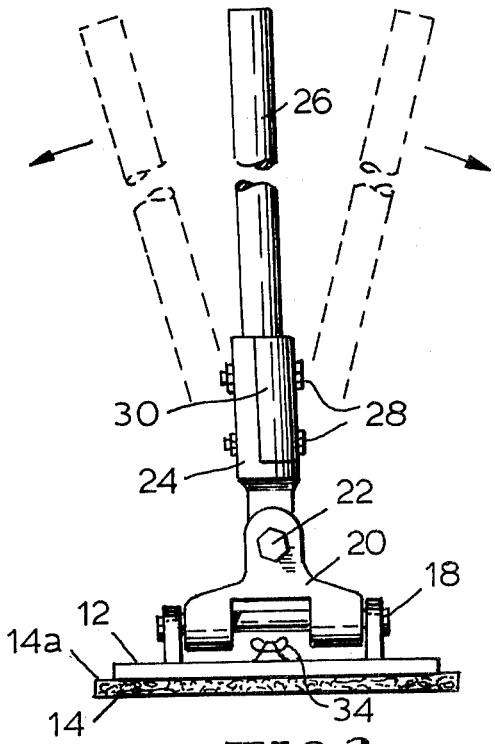
FIG. 3 shows a side elevational view 90 degrees from the view of FIG. 2 showing the handle movement.

FIG. 3 shows additional pivotal movement of the handle 90 degrees to the movement shown in FIG. 2 through movement around bolt 22 which acts as a pivotal axis.

Figure 4:
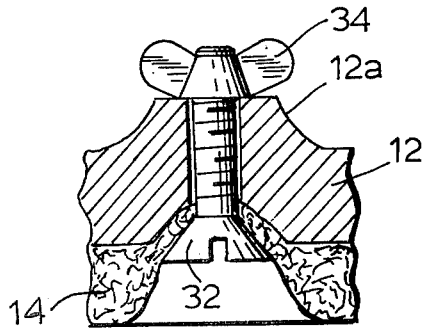
FIG. 4 shows a fragmentary view, partially in cross-section of the connection between the mounting plate and the fiber pad used in the instant invention.

FIG. 4 shows how the pad 14 is connected to the plate 12 having a boss **12*a* by carriage bolt and nut 34** which firmly holds the pad to the plate. The pad is shaped and contoured in size to overlap the peripheral edges of the plate approximately one-half inch.

In operation, the operator would press the pad and plate against the tile and tile grouting joint in a back and forth motion to remove the excess grouting. The pad is constructed of a steel wool-like fiberous material known under the trademark of SCOTCHBRITE, manufactured by the 3M Company. The pad may be cleaned and used again and when worn readily removed and a new pad replaced by removing the bolt and nut. The pivotal movement of the handle in mutually perpendicular planes allows for the pad surface and plate to be moved in relatively inaccessible areas.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A tile scrubbing and cleaning tool, comprising:

a rigid, flat rectangular plate, said plate having an upper surface and a lower surface;

a pair of flanges connected and integrally formed on the top of said plate, said flanges being parallel and having a pair of apertures, one in each flange, axially aligned for receipt of a shaft;

an elongated handle;

a handle socket for receiving one end of said handle, said socket including a movable joint for planar movement in a first plane;

a shaft connected between said flanges through said apertures;

a second joint member connected movably to said shaft for planar movement perpendicular to said first joint member, said second joint member and said shaft being spaced above the mid portion of said flat plate;

a fibrous pad attachable to the bottom surface of said flat plate, said flat plate including a central aperture for receiving a threaded connector; and a threaded connector for attaching said pad to said plate, said threaded connector including a tapered head portion at one end, said tapered head having a diminishing diameter toward said threaded connector shaft, and a threaded nut attachable to the opposite end of said threaded connector, said spacing between said second joint and said plate upper surface for allowing access for installation or removal of said threaded connector whereby said pad may be easily installed or removed by separation of said threaded connector from said plate.

* * * * *